US005928587A

United States Patent [19]

Schippers

[11] Patent Number: 5,928,587

[45] Date of Patent: Jul. 27, 1999

[54] PROCESS AND APPARATUS FOR COOLING MELT SPUN FILAMENTS DURING FORMATION OF A MULTI-FILAMENT YARN

[75] Inventor: Heinz Schippers, Remscheid, Germany

[73] Assignee: Barmag AG, Remscheid, Germany

[21] Appl. No.: 08/920,168

[22] Filed: Aug. 27, 1997

[30] Foreign Application Priority Data

Aug. 28, 1996 [DE] Germany ..... 196 34 724

[51] Int. Cl.[6] ..... D01D 5/084; D01D 5/092; D02G 3/00

[52] U.S. Cl. ..... 264/103; 264/211.14; 264/211.15; 264/211.17; 425/72.2; 425/378.2; 425/379.1; 425/382.2; 425/445

[58] Field of Search ..... 264/103, 211.14, 264/211.15, 211.17, 234, 237; 425/72.2, 378.2, 379.1, 382.2, 404, 445

[56] References Cited

U.S. PATENT DOCUMENTS

| | | | |
|---|---|---|---|
| 3,732,346 | 5/1973 | Mallonee et al. . | |
| 4,529,368 | 7/1985 | Makansi | 425/72.2 |
| 4,909,976 | 3/1990 | Cucolo et al. | 264/211.15 |
| 5,173,310 | 12/1992 | Katou et al. | 425/72.2 |
| 5,645,782 | 7/1997 | Howell et al. | 264/103 |
| 5,661,880 | 9/1997 | Schippers et al. | 28/240 |

FOREIGN PATENT DOCUMENTS

| | | |
|---|---|---|
| 334604 | 9/1989 | European Pat. Off. . |
| 726338 | 8/1996 | European Pat. Off. . |

OTHER PUBLICATIONS

Patent Abstracts of Japan, vol. 095, No. 008, Sep. 29, 1995 & JP 07118915, May 9, 1995.

*Primary Examiner*—Leo B. Tentoni
*Attorney, Agent, or Firm*—Alston & Bird LLP

[57] ABSTRACT

A process and apparatus for cooling freshly spun polymeric filaments as part of the formation of a multi-filament yarn, wherein the filaments are passed serially through a first cooling zone, a heating zone, and a second cooling zone. The resulting filaments have an improved elongation at break and an improved stretchability.

23 Claims, 4 Drawing Sheets

PROCESS AND APPARATUS FOR COOLING MELT SPUN FILAMENTS DURING FORMATION OF A MULTI-FILAMENT YARN

BACKGROUND OF THE INVENTION

The present invention relates to a process and apparatus for spinning a multi-filament yarn, of the general type disclosed in U.S. Pat. No. 4,529,368.

The process of the present invention is distinguished by the fact that, after emerging from the spinneret, the filaments are not subjected directly to cross-flow blowing of cooling air. Rather, the filaments first pass through a first cooling zone with a view to stabilizing the cross-section of the yarn. By this construction, a high degree of uniformity of the filaments is achieved.

However, in the course of further cooling in a second cooling zone, at a preset draw-off speed of 3,000 m/min for example, the chains of molecules are frozen with a pre-orientation. The pre-orientated yarn (POY) produced in this way displays a reduced elongation at break and hence reduced stretchability in the subsequent treatment process.

EP 0 334 604 discloses a process in which, after emerging from the spinneret, the filaments directly enter a blowing stage. In this connection the filaments are cooled with tempered air, whereby a weaker cooling effect is sought in the upper region than in the lower region.

A process is also described in EP 0 726 338 and corresponding U.S. Pat. No. 5,661,880 in which the filaments are additionally warmed immediately upon emerging from the nozzle plate of the spinneret.

In both processes the filaments are blown directly with a current of air with a view to cooling, so that irregularities arise, particularly in the case of thin filaments.

It is accordingly an object of the present invention to provide an improved process of the type described above, as well as an apparatus for the application of the process in such a way that it is possible to produce a yarn having a high degree of uniformity and a high stretching capacity—i.e., a high elongation at break.

SUMMARY OF THE INVENTION

The above and other objects and advantages of the present invention are achieved by the provision of a process and apparatus wherein the heated and melted thermoplastic polymer is extruded through a plurality of apertures in a nozzle plate of a spinneret to form a plurality of downwardly advancing filaments. The filaments are serially (1) cooled by passing the advancing filaments through a first cooling zone disposed immediately below the nozzle plate, (2) warmed by passing the advancing filaments through a heating zone disposed immediately below the first cooling zone, and (3) cooled by passing the advancing filaments through a second cooling zone immediately below the heating zone. The advancing filaments are then gathered together to form an advancing multi-filament yarn, which may then be wound into a package.

With the process according to the invention the filaments emerging from the nozzle plate are first cooled in the first cooling zone, which ensures that the filament skin initially solidifies. It is consequently no longer possible that the molten filament deliquesces—i.e., forms thicker or thinner portions. Also, a high degree of uniformity of the filaments is achieved. In the further course of the process, the yarn is then warmed in a heating zone to a temperature lying within the plastification range of the polymer but below the solidification temperature. By this arrangement, the frozen chains of molecules are broken open again, so that the mobility of the chains of molecules results in disorientation. The filaments are subsequently cooled again in the second cooling zone.

The process according to the invention has the advantage that as a result of the disorientation, an increase in the elongation at break of the yarn is achieved and hence, for a preset draw-off speed, subsequent stretchability of the yarn can be increased.

The warming of the filaments in the heating zone is advantageously effected by irradiation. In this connection use is preferably made of radiant heaters having a surface temperature of more than 400° C.

In the course of heating up the filaments by the combination of irradiation with a current of cooling air, the current of cooling air prevents the hot air that leaves the heating zone from reaching the cooling region of the first cooling zone.

The process variant in which the cooling of the filaments in the first cooling zone is effected with the aid of weak blowing of air should be used in particular for the production of technical yarn.

The cooling of the filaments in the second cooling zone can be effected both with air blowing and without air blowing. Depending on the combination, the physical properties of the yarn can consequently be adjusted advantageously.

With a view to warming the filaments in the heating zone it is advantageous that the apparatus according to the invention comprise radiant heaters on both sides of the bundle of advancing filaments. In one preferred embodiment, the bundle of filaments is enveloped by the radiant heater which results in particularly uniform warming of the filaments.

In another preferred embodiment, the radiant heaters are arranged in the form of heated reflector plates in the cooling shaft. In this connection, it is advantageous if an already warmed current of air is supplied by a cross-flow blowing stage. By means of the reflector plates the current of air that has been cooled by the bundle of filaments is heated again and guided back to the bundle of filaments. By this arrangement, a high degree of uniformity of the heat treatment of the filaments is achieved.

BRIEF DESCRIPTION OF THE DRAWINGS

Some of the objects and advantages of the present invention having been stated, others will appear as the description proceeds, when considered in conjunction with the accompanying schematic drawings, in which.

DETAILED DESCRIPTION OF THE PREFERRED EMBODIMENTS

Figure 1:
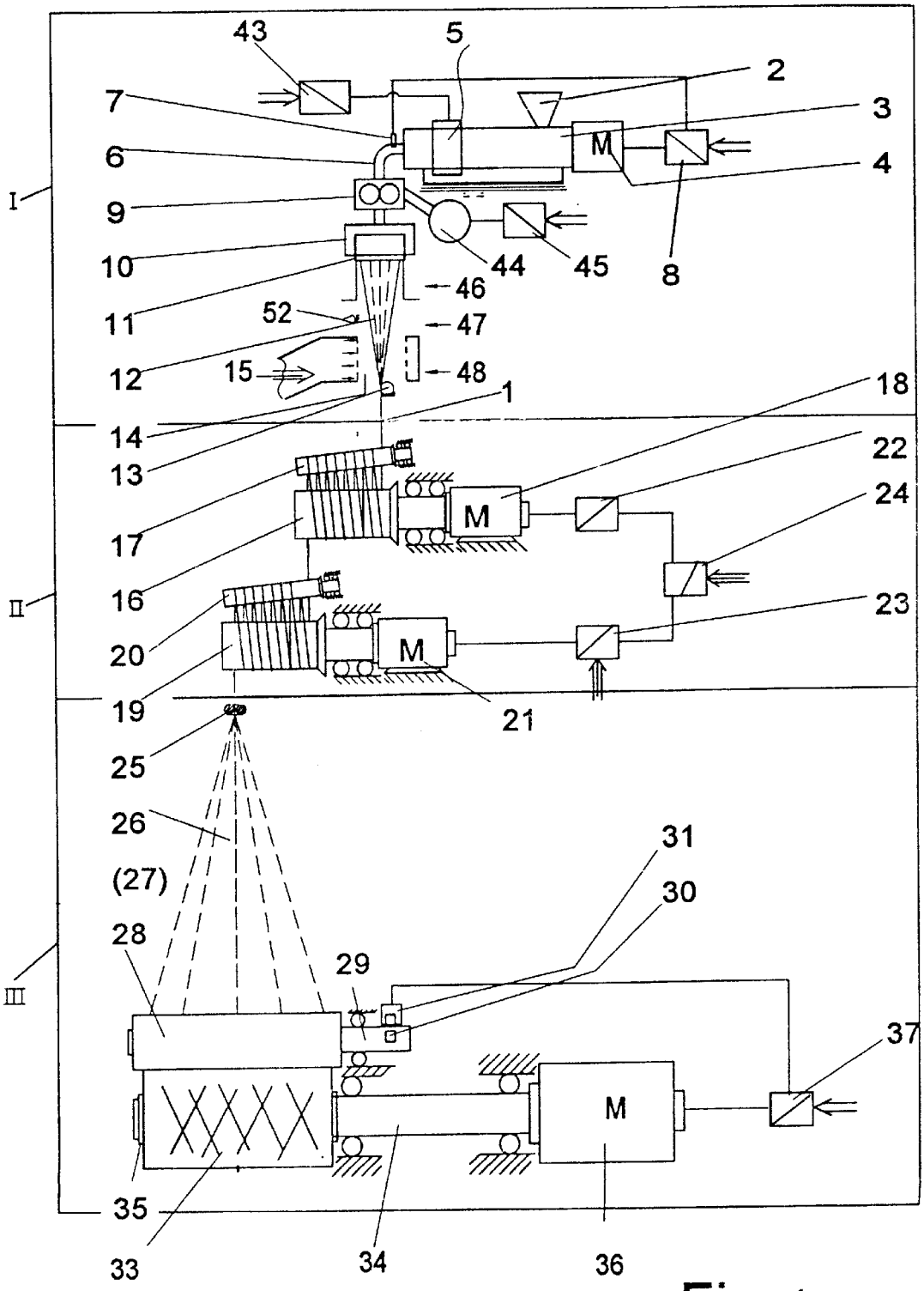
FIG. 1 is an illustration of a melt spinning apparatus which incorporates the features of the present invention.

Shown schematically in FIG. 1 is a spinning apparatus that consists of a spinning zone I, a drawing zone II, and a winding zone III. In this connection the thermoplastic polymer is fed into the extruder 3 by a filling device. The extruder 3 is driven by a motor 4 which is controlled by a motor control system 8. The thermoplastic polymer is heated and melted in the extruder. This purpose is achieved, on the one hand, by the deformation work that is introduced into the material by the extruder. In addition a heating device 5 in the form of a resistance heating unit is provided which is controlled by means of a heating control system 43. Through the melt pipe the melt reaches the gear pump 9 which is driven by the pump motor 44. The pressure of the melt ahead of the pump is detected by the pressure transducer 7 and kept constant by feedback of the pressure signal to the motor control system 8.

The pump motor is controlled by the pump control system 45 in such a way that the rotational speed of the pump is capable of sensitive adjustment. The pump 9 conveys the current of melt to the heated spinneret 10, on the underside of which an apertured nozzle plate 11 is located in a nozzle pot 53. From the nozzle plate 11, the melt emerges in the form of fine filaments 12. The filaments 12 then advance downwardly through a cooling shaft 14 for cooling the filaments, and which is arranged vertically below the nozzle plate 11. The filaments 12 first enter a first cooling zone 46 which in the embodiment of FIG. 1 is bounded by air impermeable walls. Directly connected below the first cooling zone is a heating zone 47, in which the filaments 12 are heated up by means of a radiator 52. Directly connected below the heating zone is a second cooling zone 48, in which a current of air is directed transversely in relation to the advance of the filaments through an air permeable blow wall. For this purpose, the air permeable blow wall is connected to an air supply 15.

At the end of the cooling shaft 14 the filament bundle is combined by means of a preparation roller 13 to form a yarn 1 and is provided with a processing liquid. The yarn 1 then enters the drawing zone II. In this connection, the yarn 1 is drawn out of the cooling shaft 14 and from the spinneret by means of a draw-off godet 16. The yarn wraps repeatedly around the draw-off-godet. This purpose is served by an overflow roller 17 that is arranged crosswise in relation to the godet 16, and which is freely rotatable. By means of the godet motor 18 and the frequency transmitter 22 the godet 16 is driven at a speed that is capable of being preset. This draw-off speed is higher by a multiple than the natural discharge speed of the filaments from the spinneret 11. By adjustment of the initial frequency of the frequency converter 22 it is possible for the rotational speed of the draw-off godet 16 to be set. By this arrangement, the draw-off speed of the yarn 1 from the nozzle plate 1 is determined. The draw-off godet 16 is followed by a stretching godet 19 with an additional overflow roller 20. Both correspond in their construction to the draw-off godet 16 and the overflow roller 17. The stretching motor 21 with the frequency transmitter 23 serves to drive the stretching godet 19. The initial frequency of the frequency converters 22 and 23 is preset uniformly by the controllable frequency transmitter 24. In this manner the rotational speeds of the draw-off godet 16 and of the stretching godet 19 can be set individually with the aid of the frequency converters 22 and 23. The speed level of the draw-off godet 16 and the stretching godet 19, on the other hand, is set collectively by the frequency converter 24.

From the stretching godet 19 the yarn 1 runs into the winding zone III and there to the top thread guide 25 and from there into the traversing triangle 26. The yarn then runs into a traversing device (not shown), wherein the yarn is guided to and from along a traversing stroke by means of guide elements. In this connection the traversing device may be constructed in the form of an inverse thread roller with a traversing thread guide borne thereon or in the form of a flyer traversing device. From the traversing device the yarn runs via a contact roller 28 to the package 33 that is to be wound. The contact roller 28 rests in close contact with the surface of the package 33, and it serves for measuring the surface speed of the package 33. The package 33 is formed on a tube 35, which is coaxially mounted upon a winding spindle 34. The spindle 34 is driven by the spindle motor 36 and the spindle control system 37 in such a way that the surface speed of the package 33 remains constant.

To this end, by way of controlled process variable, the rotational speed of the freely rotatable contact roller 28 on the contact roller shaft 29 is scanned and fully controlled by means of a ferromagnetic insert 30 and a magnetic pulse generator 31.

The process according to the invention for spinning a multi-filament yarn is not restricted to the arrangement shown in FIG. 1. In principle the process may also be carried out in an arrangement of the type in which the drawing zone II comprises only a draw off godet. It is also possible to operate the spinning zone I directly with the winding zone III—that is to say, without any godet.

Figure 2:
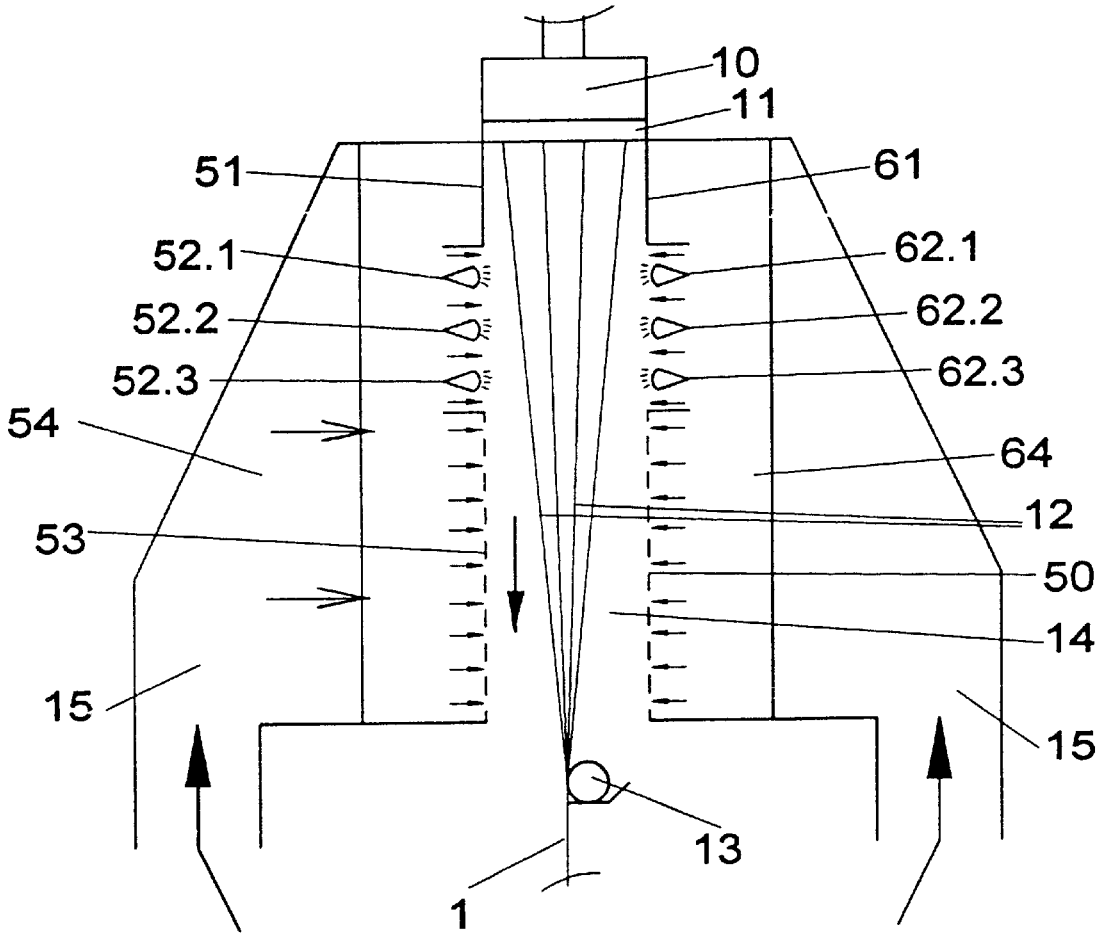
FIG. 2 is a sectional side elevation view of a cooling shaft for the melt spinning in accordance with one embodiment of the invention.

FIG. 2 illustrates another embodiment for cooling the filaments in the spinning zone in accordance with the invention. Directly below the nozzle plate 11, a cooling shaft 14 that receives the filaments 12 is formed by blower casings 54 and 64 arranged on both sides. Immediately below the nozzle plate 11 the blower casings 54 and 64 comprise the air impermeable side walls 51 and 61. The side walls 51 and 61 form the first cooling zone. Depending on polymer type and yarn type, the first cooling zone has a length of about 250 mm to 500 mm.

Below the side walls 51 and 61 several radiant heaters 52.1, 52.2, 52.3 and 62.1 to 62.3 are arranged, located opposite one another and directed towards the filaments. In this connection the radiant heaters 52.1–52.3 and 62.1–62.3 are arranged in the cooling shaft 14 underneath one another parallel to the bundle of filaments 12 subject to a spacing in relation to one another, so that an intake of air between the radiant heaters into the cooling shaft 14 becomes possible. The radiant heaters preferably have a surface temperature lying above 400° C. Below the radiant heaters the cooling shaft 14 is formed by air permeable side walls 53 and 50. The blower casing 54 and the blower casing 64 are in each instance connected to an air supply 15. The air that is blown in now extends into the cooling shaft 14 via the spaces between the radiant heaters 52.1–52.3 and 62.1–62.3 and through the air permeable blow walls 53 and 50. Arranged below the cooling shaft 14 is the preparation roller 13, where the bundle of filaments 12 is combined to form a yarn 1.

Figure 3:
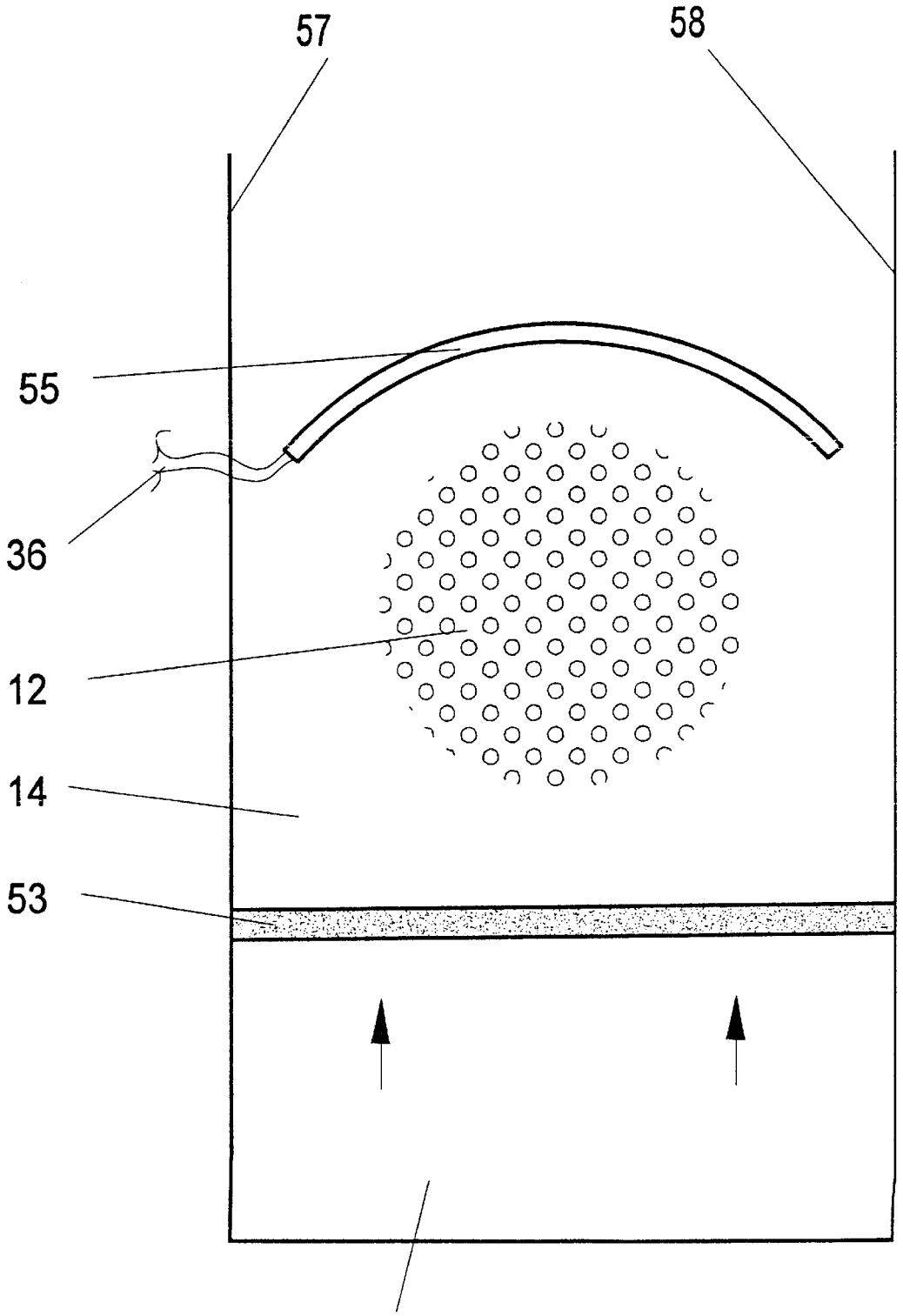
FIG. 3 is a transverse sectional view of another embodiment of the cooling shaft of the present invention.

FIG. 3 illustrates one embodiment for the cross-section of the heating zone of a blower chamber 54. In this connection, the bundle of filaments 12 passes through the cooling shaft 14, and the cooling shaft 14 is bounded by the side walls 57 and 58. The blower casing 54 includes a wall 53 which is arranged in relation to the bundle of filaments in such a way that the in flowing air in the blower casing 54 flows through the wall 53 and along the side walls 57 and 58 transversely in relation to the filaments. Arranged opposite the wall 53 on the opposite side of the bundle of filaments is a reflector plate 55. The reflector plate is heated by means of a resistance heating wire 56. Hence a direct heating of the filaments and also a warming of the cooling air that flows back is generated.

Figure 4:
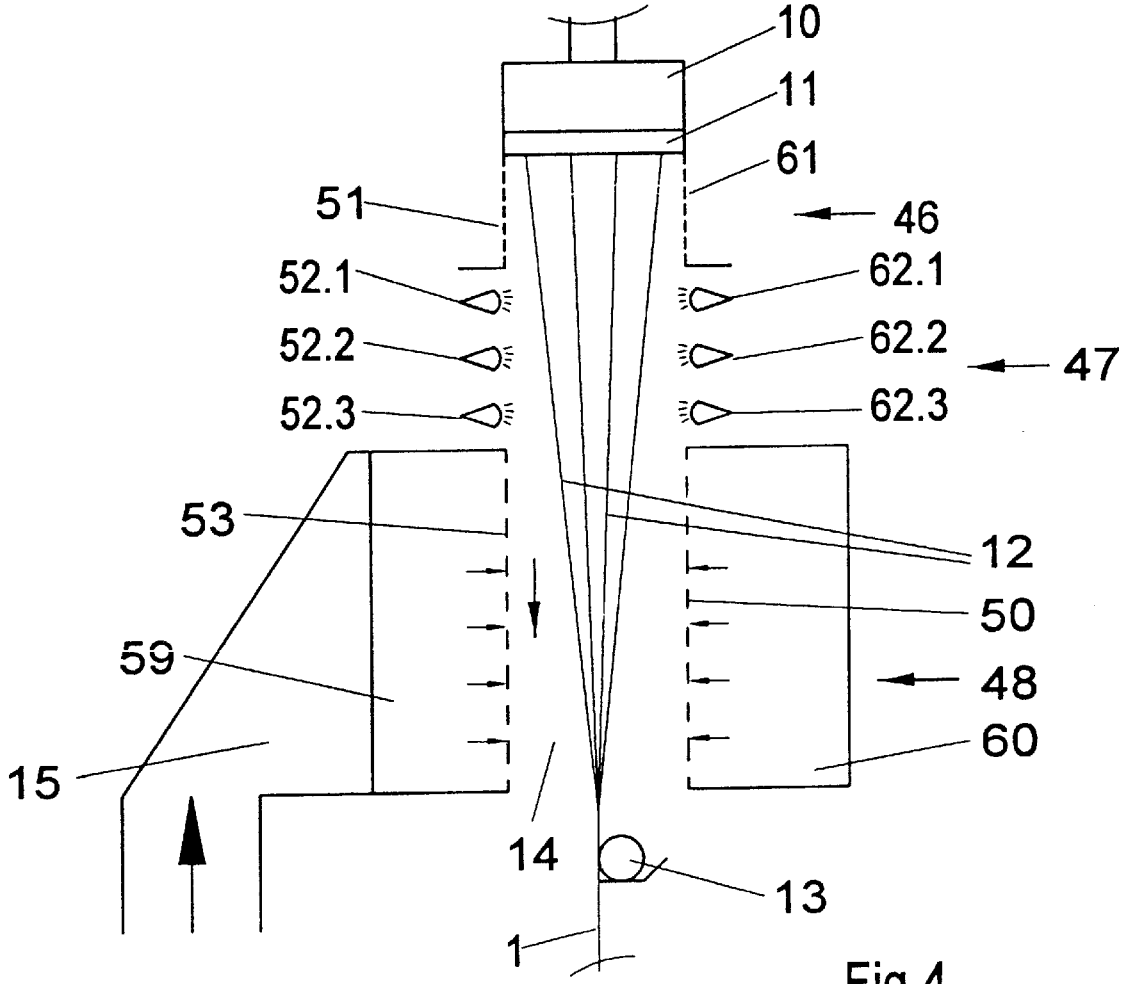
FIG. 4 is a view similar to FIG. 2 and illustrating another embodiment of the cooling shaft of the present invention.

FIG. 4. illustrates another embodiment of the cooling shaft of the present invention. In comparison with the arrangement shown in FIG. 2, the side walls 51 and 61 of the cooling shaft 14 are constructed to be air-permeable directly below the nozzle plate 11. The radiant heaters 52.1–52.3 and 62.1–62.3 arranged on both sides of the bundle of filaments are also once again arranged so as to be axially spaced apart. This makes it possible for the ambient air to flow into the cooling shaft and consequently, particularly in the first cooling zone, results in a better cooling effect. In this connection the blower casing 59 is arranged below the first cooling zone 46 and the heating zone 47. The blower casing 59 is connected to the air supply 15. The walls 53 and 50 are air permeable, so that a current of air flows out of the casings 59 and 60 into the cooling shaft 14 transversely in relation to the bundle of filaments 12. Below the cooling shaft 14 a preparation device 13 is again arranged in order to form the yarn 1.

In the case of the processes with high draw-off speeds the second cooling zone 48 is also advantageously designed in such a way that self-generating current of air is drawn into the cooling shaft 14. In this case an active blowing stage would be unnecessary.

Another advantageous further development of the process is constituted by a variant wherein the current of air is blown into the cooling shaft 14 from below, which consequently flows opposite the direction of the advance of the yarn.

With the process of the present invention it has been shown that the elongation at break of the yarns is increased by >5%. The increase in stretchability is accordingly also augmented by >5%.

In the drawings and specification, there has been set forth a preferred embodiment of the invention, and although specific terms are employed, they are used in a generic and descriptive sense only and not for purposes of limitation.

That which is claimed is:

1. A process for spinning a multi-filament yarn from a heated and melted thermoplastic polymer comprising the steps of extruding the heated and melted thermoplastic polymer through a plurality of apertures in a spinneret nozzle plate to form a plurality of downwardly advancing filaments, cooling the advancing filaments by passing the advancing filaments through a first cooling zone disposed immediately below the nozzle plate and which includes causing a weak current of air to contact the filaments, then warming the cooled advancing filaments by irradiation while passing the advancing filaments through a heating zone disposed immediately below the first cooling zone, and then cooling the warmed advancing filaments by passing the advancing filaments through a second cooling zone disposed immediately below the heating zone, and while gathering the advancing filaments together to form an advancing multi-filament yarn.

2. The process as defined in claim 1 wherein the weak current of air is of a magnitude to cause the filament skin to solidify while the interior remains melted.

3. The process as defined in claim 1 wherein the step of warming the advancing filaments includes warming the filaments by irradiation while causing a current of air to contact the advancing filaments.

4. The process as defined in claim 2 wherein the irradiation is effected by a radiant heater operating at a temperature of at least about 400° C.

5. The process as defined in claim 1 wherein the initial cooling step includes applying a current of air to the advancing filaments with the current of air passing transversely from the outside toward the inside of the plurality of filaments.

6. The process as defined in claim 5 wherein the current of air is self-generated by the advance of the advancing filaments.

7. The process as defined in claim 1 wherein the second cooling step includes positively blowing a current of air transversely across the advancing filaments.

8. The process as defined in claim 1 wherein the second cooling step includes passing a current of air transversely across the advancing filaments which is self-generated by the advance of the filaments.

9. The process as defined in claim 1 wherein the warming step includes passing the advancing filaments past a plurality of axially spaced apart heaters, and so that air is free to pass between the heaters from the outside and into contact with the advancing filaments.

10. The process as defined in claim 1 wherein the warming step includes warming the filaments to a temperature lying within the plastification range of the polymer but below the solidification temperature.

11. A cooling shaft for cooling freshly spun thermoplastic filaments which have been extruded through a nozzle plate of a melt spinning machine and as the filaments advance downwardly from the nozzle plate, comprising a first cooling zone adapted to be disposed immediately below the nozzle plate for cooling the advancing filaments, a heating zone disposed immediately below the first cooling zone and including at least one radiant heater directed toward the advancing filaments for warming the advancing filaments, and a second cooling zone disposed immediately below the heating zone for cooling the advancing filaments.

12. The cooling shaft as defined in claim 11 wherein the first cooling zone includes an upper side wall which at least substantially encloses the advancing filaments, and wherein the second cooling zone includes a lower side wall which at least substantially encloses the advancing filaments.

13. The cooling shaft as defined in claim 12 wherein the upper side wall is air permeable so as to permit a current of outside air to pass transversely therethrough and across the advancing filaments.

14. The cooling shaft as defined in claim 12 wherein the lower side wall is air permeable so as to permit a current of outside air to pass transversely across the advancing filaments.

15. The cooling shaft as defined in claim 12 wherein the upper side wall is air impermeable and the lower sidewall is air permeable so as to permit a current of outside air to pass transversely therethrough and across the advancing filaments.

16. The cooling shaft as defined in claim 15 further comprising an air blower for positively delivering air to the lower side wall and so that the delivered air passes through the lower side wall and transversely across the advancing filaments.

17. The cooling shaft as defined in claim 11 wherein the heating zone comprises a plurality of axially spaced apart radiant heaters, and so that air is free to pass between the heaters from the outside and into contact with the advancing filaments.

18. The cooling shaft as defined in claim 17 wherein the lower side wall is air permeable, and further comprising an air blower for positively delivering air to an area outside the cooling shaft and so that the delivered air passes between the axially spaced apart heaters and into contact with the advancing filaments, and also through the air permeable lower side wall and into contact with the advancing filaments.

19. The cooling shaft as defined in claim 18 wherein the upper sidewall is air impermeable.

20. The cooling shaft as defined in claim 11 wherein the heating zone includes an air permeable side wall which permits a current of air to flow therethrough and transversely into contact with the advancing filaments, and wherein the heating zone further includes at least one heated reflector plate positioned so that at least a portion of the current of air is heated and guided back to the filaments by the reflector plate.

21. An apparatus for spinning a multi-filament yarn from a thermoplastic polymer, comprising an extruder for heating and melting the thermoplastic polymer and extruding the same through a plurality of apertures in a spinneret nozzle plate to form a plurality of downwardly advancing filaments, a first cooling zone adapted to be disposed immediately below the nozzle plate for cooling the advancing filaments, a heating zone disposed immediately below the first cooling zone and including at least one radiant heater directed toward the advancing filaments for warming the advancing filaments, and a second cooling zone disposed immediately below the heating zone for cooling the advancing filaments.

22. The apparatus as defined in claim 21 further comprising means for gathering the advancing filaments to form an advancing multi-filament yarn, and a winder for winding the advancing yarn into a package.

23. The apparatus as defined in claim 22 further comprising means disposed between the gathering means and the winder for drawing the advancing yarn.

* * * * *